United States Patent [19]

Okamoto et al.

[11] Patent Number: 4,833,285

[45] Date of Patent: May 23, 1989

[54] HIGH-FREQUENCY HEATING DEVICE HAVING REFLECTING PLATES FOR DISTRIBUTION OF HIGH FREQUENCY MICROWAVES

[75] Inventors: Kenzo Okamoto, Osaka; Fumihiko Kitada, Neyagawa, both of Japan

[73] Assignee: Imanishi Kinzoku Kogyo Kabushiki Kaisha, Osaka, Japan

[21] Appl. No.: 124,647

[22] Filed: Nov. 24, 1987

[51] Int. Cl.[4] ..... H05B 6/72

[52] U.S. Cl. ..... 219/10.55 F

[58] Field of Search ..... 219/10.55 F, 10.55 A, 219/10.55 E, 10.55 R

[56] References Cited

U.S. PATENT DOCUMENTS 4,176,266 11/1979 Kaneko et al. ..... 219/10.55 F
4,642,435 2/1987 Fitzmayer et al. ..... 219/10.55 F
4,673,783 6/1987 Igarashi et al. ..... 219/10.55 F

FOREIGN PATENT DOCUMENTS 52-23744 2/1977 Japan ..... 219/10.55 F
53-2742 1/1978 Japan ..... 219/10.55 F

*Primary Examiner*—Philip H. Leung

[57] ABSTRACT

A high-frequency heat cooling device in which high-frequency electric wave is introduced from a high-frequency oscillating power source into a heating chamber through a power supply opening constructed in a ceiling wall of the heating chamber, via a waveguide, comprising a plurality of reflecting plates formed by cutting the ceiling wall located at an end of said waveguide and inclining the plates in a suitable angle while the same number of power supply openings as the number of the plates being provided.

6 Claims, 2 Drawing Sheets

HIGH-FREQUENCY HEATING DEVICE HAVING REFLECTING PLATES FOR DISTRIBUTION OF HIGH FREQUENCY MICROWAVES

BACKGROUND OF THE INVENTION

1. Field of the invention

The present invention relates to a high-frequency heat cooking device (electronic range) and more particularly to a high-frequency heat cooking device provided with an improved high-frequency electric wave supply port constructed in a waveguide.

2. Prior art

This type of high-frequency heat cooking device known in the prior art has been constructed in such a manner that microwave energy is oscillated in a high-frequency oscillating power source, e.g. a magnetron and supplied into a range box from a power supply opening costructed on the ceiling wall of a heating chamber (cooking chamber) through a waveguide. With such a device based, on the prior art, an object of cooking must be irradiated evenly by the microwave energy in a uniformly distributed electric field. For this purpose, a stirrer blade is equipped in the ceiling of the heating chamber to agitate high-frequency electric waves. According to another system known in the prior art, a post comprising a dielectric material is arranged in a suitable position within the waveguide to maintain uniform distribution of the electric field. However, these high-frequency heat cooking devices known in the prior art brought about increased number of parts and complicated structure.

One object of the present invention is to provide a low cost high-frequency heat cooking device that is suitable for mass production by introducing extremely simple and low-cost machining means and eliminating unnecessary additional matters. Another object of the present invention is to irradiated high-frequency electric wave from a high-frequency oscillating power source onto a cooking object located in a heating chamber. Still another object of the present invention is to prevent dispersion of an electric wave by collecting it at a power supply port constructed with reflective plates. According to another object of the present invention, these reflective plates are formed by punching square tongues by pressing the ceiling wall of the heating chamber (cooking chamber) and bending these tongues in suitable angles towards the waveguide.

SUMMARY OF THE INVENTION

According to the present invention, high-frequency electric wave is generated in a high-frequency oscillating power source and introduced and supplied into a heating chamber through a power supply opening constructed in the ceiling wall of the heating chamber via a waveguide, with a high-frequency heat cooking device. A plurality of reflecting plates are cut and bent in the ceiling wall of the heating chamber located at an end part of said waveguide and inclined towards the waveguide in suitable angles. At the same time, the same number of power supply openings as the number of the reflecting plates is provided with the high-frequency heat cooking device according to the present invention.

It is preferable to incline the reflecting plates, for introducing high-frequency electric wave generated in the high-frequency oscillating power source into the heating chamber through power supply openings constructed in the ceiling wall of the heating chamber located at an end of the waveguide, to suitable positions where the introduction of the high-frequency electric wave is not disturbed at the said power source openings, in suitable angles.

DETAILED DESCRIPTION OF THE PREFERRED EMBODIMENT

An embodiment of the present invention is detailed in the following paragraphs referring to the attached drawings.

Figure 1:
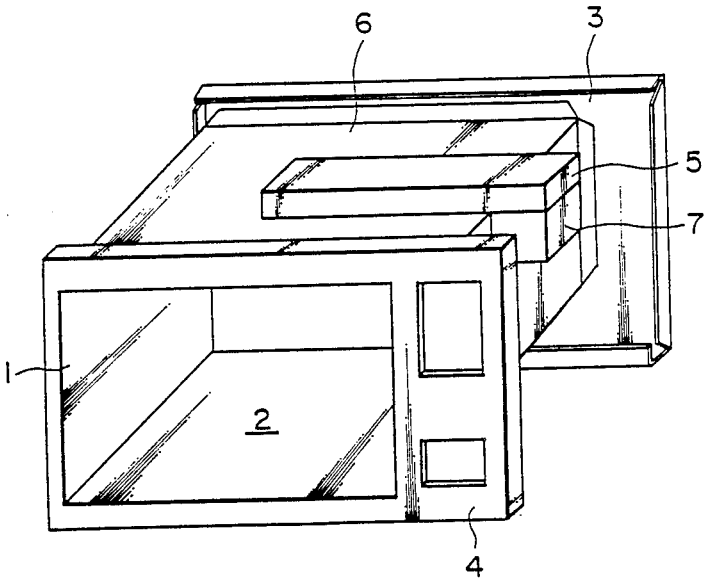
FIG. 1 is an oblique view of important parts in a high-frequency heating device according to the present invention.

FIG. 1 shows an oblique view of important parts of the basic structure after removing an outer cover of the high-frequency heat cooking device according to the present invention, in which 1 shows a housing, 2 represents a heating chamber in said housing 1, 3 a backplate attached to the rear part of housing 1 and 4 a front frame to which an open/close door, although not illustrated in FIG. 1, is hinged in a free opening/closing manner. No. 5 is a long square waveguide having an inverted T cross section and constructed in a ceiling wall 6 of heating chamber 2 while 7 representing a magnetron mounted at one end of said waveguide 5.

Figure 2:
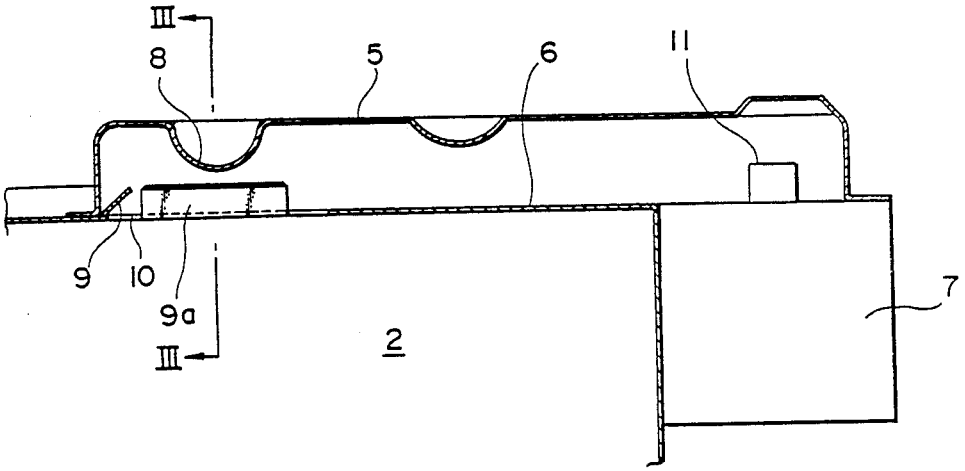
FIG. 2 shows section of a high-frequency wave supply port.
Figure 3:
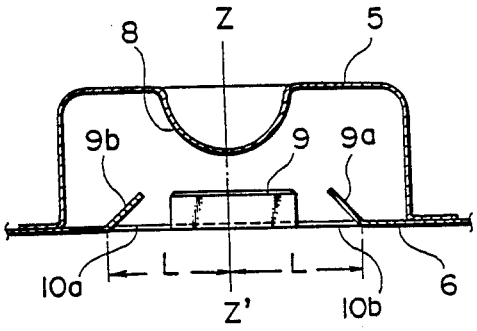
FIG. 3 is a sectional view of line III—III in FIG. 2.
Figure 4:
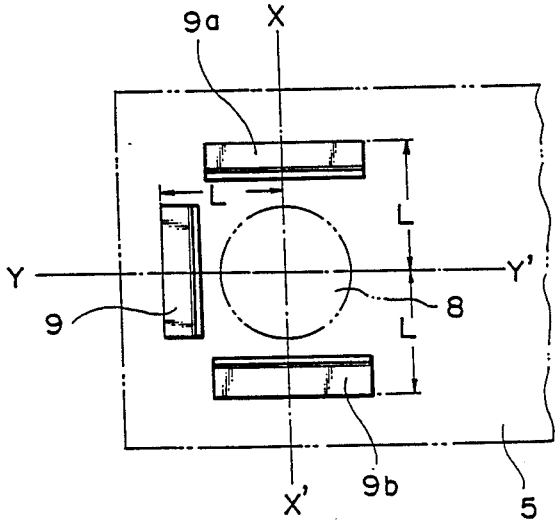
FIG. 4 is an explanatory plan view of a high-frequency wave supply port.

FIG. 2 is an enlarged sectional view of waveguide 5 mounted by spot welding onto the ceiling wall 6 of the heating chamber. The magnetron 7 is fixed at the right end of the waveguide 5. A post 8 is protrudingly provided in the inner part of the left end of said waveguide 5, on the ceiling face. Long square elevated tongues 9, 9*a*, 9*b* are pressed out at three positions, namely the left longitudinal end of the waveguide 5 and the upper and left parts of FIG. 3, in the ceiling wall 6 of the heating chamber. These positions are separated from centerlines of the post 8 X-X' and Y-Y' by specified interval L, as shown in FIGS. 3 and 4. These tongues are bent in an angle of about 45° towards the waveguide as reflecting plates. Thus, there are long square windows 10, 10*a*, 10*b* are opened where the reflecting plates were located before being pressed, in the same shape as the reflecting plates. These windows 10, 10*a*, 10*b* act as the power supply openings.

According to the present invention as described above, electric wave is oscillated from the oscillating unit (antenna) 11 of the magnetron, etc. Namely a high-frequency oscillating power source and transmitted from the right to the left in the figure, namely in longitudinal direction of the waveguide, rectified at the post, arrives at the reflecting plates erected by an angle of 45° in three directions, is reflected by about 90° and fed onto an object of cooking located in the heating chamber through the power supply openings as high-frequency electric wave energy for heating. These reflecting plates are cut in substantially the same dimensions at a part of the ceiling wall of the heating chamber, erected by pressing and bent in an angle of about 45° thus forming reflecting plates integrated with the ceiling in the heating chamber. Accordingly, no additional materials are required for the reflecting plates while saving resources. In addition, work processes are also omitted compared to a case where the reflecting plates composed of other materials are attached. Therefore, the present invention provides many practical advantages such as reduced wages, easier mass production and low cost because of simpler structure.

What is claimed is:

1. A high-frequency microwave heating device in which high-frequency microwaves are generated by a high-frequency oscillating power source, comprising:

a heating chamber for placing an object to be cooked therein;

a waveguide connecting said high-frequency power source to said heating chamber, wherein said waveguide includes a power supply opening directly connected to said heating chamber and a projection positioned directly above and extending to said power supply opening, wherein said power supply opening includes a plurality of power supply apertures, each of said apertures surrounds said projection with a substantially same distance therebetween and is provided with an inclined reflecting plate extending into said waveguide such that microwaves from said high-frequency oscillating power source are reflected by said projection and said inclined reflecting plates and transmitted uniformly into said heating chamber.

2. The high-frequency microwave heating device according to claim 1, wherein said projection is a semi-spherical projection.

3. The high-frequency microwave device according to claim 1, wherein the number of said apertures is three.

4. The high-frequency microwave heating device according to claim 1, wherein an inclined angle of each inclined reflecting plate is 45°.

5. The high-frequency microwave heating device according to claim 1, wherein each aperture has a shape of rectangle.

6. The high-frequency microwave heating device according to claim 1, wherein said power supply opening is provided in a wall common to said waveguide and said heating chamber.

* * * * *